US009884498B2

(12) United States Patent
Sakano et al.

(10) Patent No.: US 9,884,498 B2
(45) Date of Patent: Feb. 6, 2018

(54) TAPE PRINTING DEVICE AND TAPE PRINTING SYSTEM

(71) Applicant: Seiko Epson Corporation, Tokyo (JP)

(72) Inventors: Hideki Sakano, Matsumoto (JP); Shinsaku Kosuge, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/127,876

(22) PCT Filed: Mar. 24, 2015

(86) PCT No.: PCT/JP2015/058962
§ 371 (c)(1),
(2) Date: Sep. 21, 2016

(87) PCT Pub. No.: WO2015/147001
PCT Pub. Date: Oct. 1, 2015

(65) Prior Publication Data

US 2017/0106677 A1 Apr. 20, 2017

(30) Foreign Application Priority Data

Mar. 24, 2014 (JP) ..... 2014-060918
Mar. 23, 2015 (JP) ..... 2015-059203

(51) Int. Cl.
*B41J 15/04* (2006.01)
*B41J 3/407* (2006.01)
(Continued)

(52) U.S. Cl.
CPC ..... *B41J 15/044* (2013.01); *B41J 3/4075* (2013.01); *B41J 17/04* (2013.01); *B41J 17/32* (2013.01); *B41J 32/02* (2013.01)

(58) Field of Classification Search
CPC ..... B41J 15/044; B41J 3/4075; B41J 14/04; B41J 14/042; B41J 17/04; B41J 17/32; B41J 32/02
See application file for complete search history.

(56) References Cited

U.S. PATENT DOCUMENTS 5,595,447 A 1/1997 Takayama et al.
5,921,688 A * 7/1999 Furuya ..... B41J 17/32 101/288
(Continued)

FOREIGN PATENT DOCUMENTS

CN 201989424 U 9/2011
JP 9-277679 A 10/1997
(Continued)

OTHER PUBLICATIONS

Search Report received in International Application No. PCT/JP2015/058962, dated Jun. 23, 2015.

*Primary Examiner* — Julian Huffman
*Assistant Examiner* — Michael Konczal
(74) *Attorney, Agent, or Firm* — ALG Intellectual Property, LLC

(57) ABSTRACT

A tape printing device includes a cartridge loading section where a tape cartridge having a platen roller and a portion to be guided is loaded in an unloadable manner; two recess portions in which fingers for gripping the tape cartridge are inserted; a platen support shaft inserted in the platen roller; and a guide pin inserted in the portion to be guided. The guide pin is situated on a side opposite to the platen support shaft across an imaginary line connecting the two recess portions and is arranged at a site where a distance from the recess portion at a position farther from the first insertion shaft, of the two recess portions, is shorter than a distance from the recess portion at a position closer to the platen support shaft.

13 Claims, 11 Drawing Sheets

(51) Int. Cl.

| | |
|---|---|
| ***B41J 17/32*** | (2006.01) |
| ***B41J 32/02*** | (2006.01) |
| ***B41J 17/04*** | (2006.01) |

(56) References Cited

U.S. PATENT DOCUMENTS

| | | | |
|---|---|---|---|
| 6,367,995 | B1 | 4/2002 | Hashimoto et al. |
| 2010/0247209 | A1 | 9/2010 | Yamaguchi et al. |
| 2010/0247210 | A1 | 9/2010 | Yamaguchi et al. |
| 2012/0008999 | A1 | 1/2012 | Yamaguchi et al. |
| 2012/0080550 | A1 | 4/2012 | Yamaguchi et al. |
| 2012/0188325 | A1 | 7/2012 | Yamaguchi et al. |
| 2012/0189366 | A1 | 7/2012 | Yamaguchi et al. |
| 2012/0201588 | A1 | 8/2012 | Yamaguchi et al. |
| 2014/0175204 | A1 | 6/2014 | Yamaguchi et al. |
| 2015/0183246 | A1 | 7/2015 | Yamaguchi et al. |

FOREIGN PATENT DOCUMENTS

| | | | | |
|---|---|---|---|---|
| JP | 2002-178572 | A | | 6/2002 |
| JP | 2007-11281 | A | | 1/2007 |
| JP | 2007011281 | A | * | 1/2007 |
| JP | 2007-334256 | A | | 12/2007 |
| JP | 2010-280102 | A | | 12/2010 |
| JP | 2012-126141 | A | | 7/2012 |
| JP | 2012126141 | A | * | 7/2012 |
| JP | 2013-141749 | A | | 7/2013 |
| WO | WO-2000-032402 | A | | 3/2002 |

* cited by examiner

TAPE PRINTING DEVICE AND TAPE PRINTING SYSTEM

CROSS-REFERENCE TO RELATED APPLICATIONS

This application is the U.S. National Phase under 35 U.S.C. §371 of International Application No. PCT/JP2015/058962 filed on Mar. 24, 2015, which in turn claims the benefit of Japanese Application No. 2014-060918 filed on Mar. 24, 2014, and Japanese Application No. 2015-059203 filed on Mar. 23, 2015, the disclosures of which are expressly incorporated by reference herein.

TECHNICAL FIELD

The present invention relates to a tape printing device and a tape printing system which have a cartridge loading section where a tape cartridge is loaded in an unloadable manner.

BACKGROUND ART

According to the related art, as a tape printing device of this type, a tape printing device having a cassette loading section where a tape cassette is loaded in an unloadable manner is known (see JP-2012-126141).

In this tape cassette, a tape feed roller, a first tape spool with a first tape wound thereon, a ribbon spool with an ink ribbon wound thereon, and a ribbon take-up spool for taking up the ink ribbon are accommodated. Also, in a cassette case of the tape cassette, a roller support hole corresponding to the tape feed roller, a first tape support hole corresponding to the first tape spool, and a take-up support hole corresponding to the ribbon take-up spool are formed. Moreover, in the cassette case, a guide hole for guiding the loading the tape cassette, and two pin holes for positioning the cassette case are formed.

Meanwhile, in the cassette loading section of the tape printing device, a tape drive shaft corresponding to the roller support hole, a ribbon take-up shaft corresponding to the take-up support hole, a guide shaft corresponding to the guide hole, and two positioning pins corresponding to the two pin holes are provided upright.

As the tape cassette is loaded in the cassette loading section, the tape drive shaft is fitted in the tape feed roller, and the ribbon take-up shaft is fitted in the ribbon take-up spool. The guide shaft is inserted in the guide hole, and the two positioning pins are inserted in the two pin holes.

In this case, the tape drive shaft and the guide shaft protrude largely from the cassette loading section, and the tape feed roller (roller support hole) and the guide hole corresponding to these are arranged at diagonal positions as viewed in a plan view, in the tape cassette. Thus, the tape cassette is loaded accurately and smoothly in the cassette loading section.

SUMMARY

Such a tape printing device according to the related art has a problem that the tape cassette tilts and cannot be loaded or unloaded smoothly if the tape drive shaft and the guide shaft largely protruding from the cassette loading section are not sufficiently spaced apart from each other, in other words, if the roller support hole and the guide hole of the tape cassette are not sufficiently spaced apart from each other. Also, if the site for gripping the tape cassette, and the roller support hole and the guide hole, are not arranged with good balance, the loading force and the pull-out force become lopsided. Also in this respect, the problem of the tape cassette tilting and twisting and being unable to be loaded or unloaded smoothly arises.

An object of the invention is to provide a tape printing device and a tape printing system in which a tape cartridge can be loaded and unloaded smoothly.

A tape printing device according to the invention includes: a cartridge loading section where a tape cartridge which has a first receiving portion and a second receiving portion extending in a loading/unloading direction and arranged spaced apart from each other is loaded in an unloadable manner; two recess portions which continue from the cartridge loading section and in which fingers for gripping the loaded tape cartridge are inserted; a first insertion shaft provided in the cartridge loading section and inserted in the first receiving portion of the loaded tape cartridge; and a second insertion shaft provided in the cartridge loading section and inserted in the second receiving portion of the loaded tape cartridge. As viewed from a loading direction of the tape cartridge, the second insertion shaft is situated on a side opposite to the first insertion shaft across an imaginary line connecting the two recess portions and is arranged at a site where a distance from the recess portion at a position farther from the first insertion shaft, of the two recess portions, is shorter than a distance from the recess portion at a position closer to the first insertion shaft.

According to this configuration, the second insertion shaft is situated on the side opposite to the first insertion shaft across the imaginary line connecting the two recess portions and is arranged at the site where the distance from the recess portion at the position farther from the first insertion shaft, of the two recess portions, is shorter than the distance from the recess portion at the position closer to the first insertion shaft. Therefore, the distance between the first insertion shaft and the second insertion shaft is long. Therefore, the first insertion shaft (first receiving portion) and the second insertion shaft (second receiving portion) are in a well-balanced diagonal positional relation with respect to the gripping position of the tape cartridge gripped via the recess portions. Thus, at the time of loading and unloading the tape cartridge, the force applied via the site to be gripped acts relatively evenly on the first receiving portion (first insertion shaft) and the second receiving portion (second insertion shaft). Thus, the tape cartridge does not easily twist with respect to the first insertion shaft and the second insertion shaft and can be loaded and unloaded smoothly. Also, the first insertion shaft and the second insertion shaft exist in easily recognizable places on the cartridge loading section and function, together with the first receiving portion and the second receiving portion of the tape cartridge, as landmarks that enable easy recognition of the forward-back and left-right directions at the time of loading. Thus, the tape cartridge can be directed in the correct direction and thus loaded in the cartridge loading section. Also in this respect, the tape cartridge can be loaded and unloaded smoothly.

In this case, it is preferable that the first insertion shaft rotatably supports a platen roller provided in the tape cartridge and using the first receiving portion as a shaft hole, in the state where the tape cartridge is loaded.

According to this configuration, the shaft rotatably supporting the platen roller can be the same as the first insertion shaft, and the number of components provided for guiding the loading and unloading of the tape cartridge can be reduced.

In this case, it is preferable that a clearance between the second insertion shaft and the second receiving portion is smaller than a clearance between the platen roller and a roller receiving portion of a cartridge case which rotatably supports the platen roller.

According to this configuration, at the time of loading and unloading the tape cartridge, the twisting between the first receiving portion and the first insertion shaft (platen roller) generated via the platen roller and the roller receiving portion can be restrained by insertion and release between the second insertion shaft and the second receiving portion. Thus, also in this respect, the tape cartridge can be loaded and unloaded smoothly. Also, the tape cartridge can be accurately positioned on the cartridge loading section.

It is also preferable that the first insertion shaft and the second insertion shaft penetrate the tape cartridge in the state where the tape cartridge is loaded.

According to this configuration, the contact dimension between the first insertion shaft and the first receiving portion, and the contact dimension between the second insertion shaft and the second receiving portion can be maximum lengths. Thus, since the tape cartridge does not easily tilt at the time of loading and unloading, the tape cartridge can be loaded and unloaded smoothly.

Moreover, it is preferable that the second insertion shaft is formed integrally with a loading base portion of the cartridge loading section where the tape cartridge sits.

According to this configuration, the second insertion shaft can be formed easily.

Similarly, it is preferable that the second insertion shaft is screwed, at a proximal end part, together with a loading base portion of the cartridge loading section where the tape cartridge sits.

According to this configuration, the second insertion shaft can be easily installed in the cartridge loading section with predetermined position accuracy.

Similarly, it is preferable that the first insertion shaft and the second insertion shaft are fixed to a device frame at a proximal end part and extend, penetrating a loading base portion of the cartridge loading section where the tape cartridge sits.

According to this configuration, the first insertion shaft and the second insertion shaft can be installed firmly and with high position accuracy.

Meanwhile, it is preferable that a distal end part of the second insertion shaft is hemispherically formed.

According to this configuration, at the time of loading the tape cartridge, the second receiving portion and the second insertion shaft can be easily positioned with each other and the tape cartridge can be loaded smoothly.

A tape printing system according to the invention includes: the above tape printing device; and the tape cartridge loaded in the cartridge loading section in an unloadable manner.

According to this configuration, the tape cartridge can be loaded and unloaded smoothly and the easiness of handling the tape printing device can be improved.

DESCRIPTION OF EXEMPLARY EMBODIMENTS

Hereinafter, a tape printing device and a tape printing system according to an embodiment of the invention will be described, referring to the accompanying drawings. This tape printing device is configured to perform printing while reeling off a print tape and an ink ribbon from a tape cartridge loaded therein, and cut a printed part of the print tape, thus preparing a label (tape piece). Also, the tape printing system is made up of this tape printing device and a tape cartridge loaded and used therein.

[Outline of Tape Printing Device]

Figure 1:
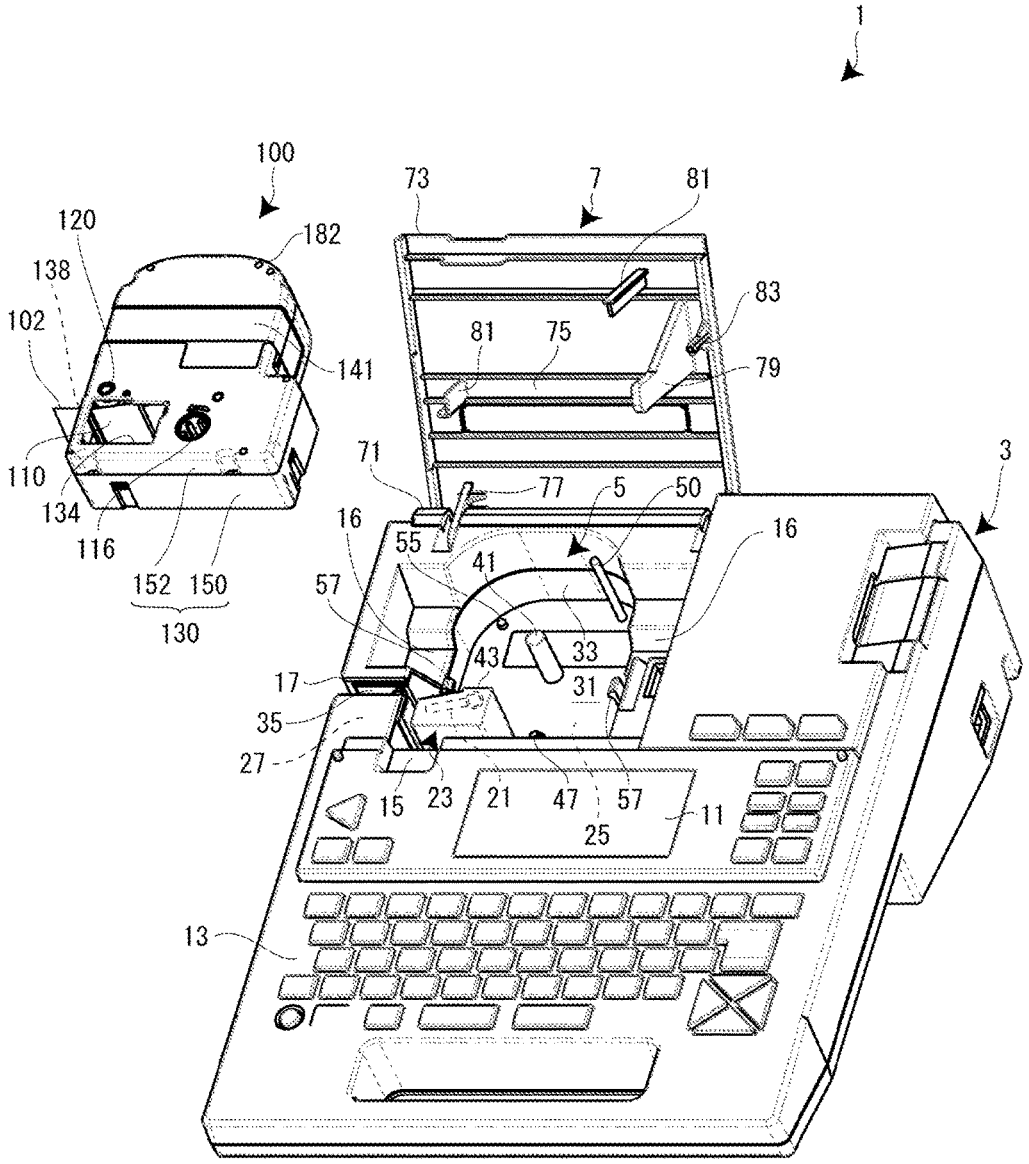
FIG. 1 is an external perspective view of an open-cover state of a tape printing device according to an embodiment.

FIG. 1 is an external perspective view of a tape printing device and a tape cartridge loaded therein. As shown in FIG. 1, a tape printing device 1 includes a device case 3 forming an outer shell, a cartridge loading section 5 in which a tape cartridge 100 is loaded in an unloadable manner, and an open/close cover 7 which opens and closes the cartridge loading section 5. On atop surface of the device case 3, the cartridge loading section 5 is provided on the rear side, a display 11 is provided in the center, and a keyboard 13 is provided on the forward side. A concave portion 15 to hook a finger is provided near the open/close cover 7. The open/close cover 7 is opened by having a finger hooked on this concave portion 15 and lifting up the open/close cover 7. Then, on a lateral side (left side) of the device case 3, a vertically long tape discharge port 17 through which a print tape 102 is discharged is provided.

Also, the tape printing device 1 includes a print mechanism section 23 having a print head 21 provided upright in the cartridge loading section 5, a tape feed mechanism section 25 provided inside the space on the back of the cartridge loading section 5, and a tape cutting mechanism section 27 provided inside near the tape discharge port 17. The user inputs print information from the keyboard 13, confirms the print information on the display 11, and subsequently executes printing by a key operation. As a print command is given, the tape feed mechanism section 25 is driven, thus causing the print tape 102 and an ink ribbon 110 to travel in parallel. Moreover, due to the heat applied to the ink ribbon 110 from the print mechanism section 23, the ink of the ink ribbon 110 is transferred to the print tape 102, thus carrying out printing. By this print feed, the print tape 102 is discharged from the tape discharge port 17. When the printing is completed, the tape cutting mechanism section 27 is driven, thus cutting the printed part of the print tape 102.

[Outline of Tape Cartridge]

As shown in FIGS. 2A, 2B, 5A, and 5B, the tape cartridge 100 includes a tape roll 106 having the print tape 102 wound on a tape core 104, and a ribbon roll 114 having the ink ribbon 110 wound on a reel-off core 112. Also, the tape cartridge 100 includes a take-up core 116 which takes up the ink ribbon 110 after use, and a platen roller 120 (platen) against which the print head 21 abuts and which feeds the print tape 102 and the ink ribbon 110. Moreover, the tape cartridge 100 has a cartridge case 130 accommodating the tape roll 106, the ribbon roll 114, the take-up core 116, and the platen roller 120. In this way, the tape cartridge 100 in this embodiment has a so-called shell structure in which the outer shell is covered by the cartridge case 130.

Also, in the tape cartridge 100, an insertion opening 134 in which the print head 21 is inserted when the tape cartridge 100 is loaded in the tape printing device 1 is formed in the cartridge case 130. The tape cartridge 100 has a tape outlet port 138 which is formed in the cartridge case 130 and through which the print tape 102 is sent out. Also, as will be described in detail later, the tape roll 106 is rotatably supported on a cylindrical core shaft 192 provided in a protruding manner on the inside of the cartridge case 130.

As the platen roller 120 and the take-up core 116 are driven by the above tape feed mechanism section 25, the print tape 102 is reeled off from the tape core 104, and the ink ribbon 110 is reeled off from the reel-off core 112. The print tape 102 and the ink ribbon 110, thus reeled off, travel in parallel at the part of the platen roller 120 and are used for printing by the print head 21. The reel-off end (printed part) of the print tape 102 where printing has been done is sent out toward the tape discharge port 17 from the tape outlet port 138. Meanwhile, the ink ribbon 110 travels around a peripheral wall part of the insertion opening 134 and is taken upon the take-up core 116. As the tape cartridge 100, a plurality of types with different thicknesses is prepared according to the tape widths of the print tape 102.

[Details of Tape Printing Device]

Figure 3:
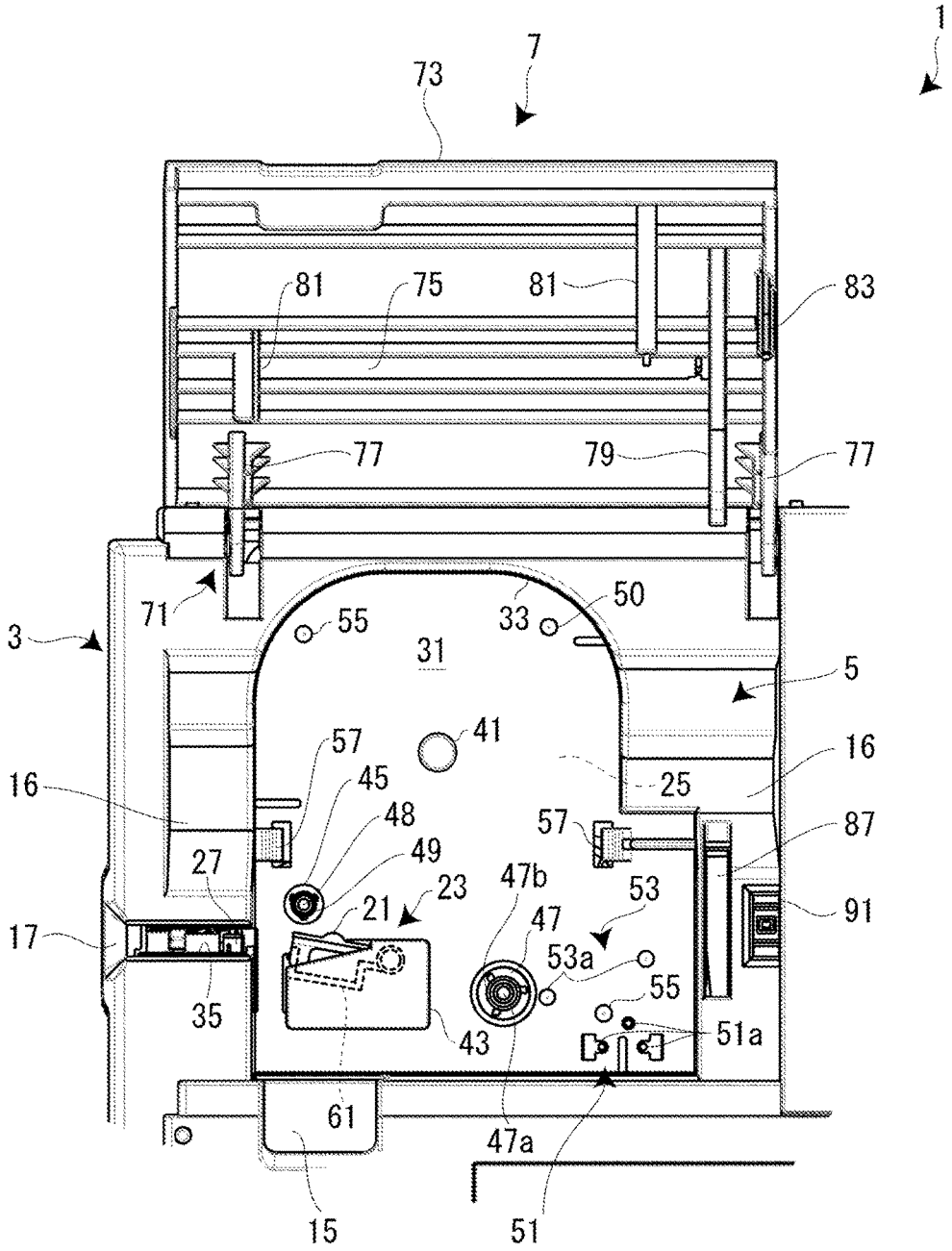
FIG. 3 is a top view of a cartridge loading section.

As shown in FIG. 1 and FIG. 3, the cartridge loading section 5 is formed in a planar shape complementary to the planar shape of the tape cartridge 100 and is concavely formed to a depth corresponding to the tape cartridge 100 with a maximum thickness, of the plurality of types of loadable tape cartridges 100. In this case, a loading base 31 (loading base portion) forming a bottom plate part of the cartridge loading section 5, and a side plate portion 33, are integrally formed (molded) of a resin or the like. A slit-like tape discharge path 35 is formed between the cartridge loading section 5 and the above tape discharge port 17, and the above tape cutting mechanism section 27 is arranged inside this part.

Also, two recess portions 16 continuing from the cartridge loading section 5 are provided on both sides of the cartridge loading section 5. The two recess portions 16 form insertion spaces where fingers to grip the tape cartridge 100 or fingers gripping the tape cartridge 100 are inserted when loading the tape cartridge 100 in the cartridge loading section 5 and when extracting (releasing) the tape cartridge 100 loaded in the cartridge loading section 5. That is, the two recess portions 16 are arranged at positions adjacent to the cartridge loading section 5 and corresponding to the parts to be gripped of the tape cartridge 100. Then, the two recess portions 16 are formed by parts extended from the loading base 31 and are to be opened and closed by the open/close cover 7 along with the cartridge loading section 5.

Meanwhile, on the loading base 31 of the cartridge loading section 5, a positioning protrusion 41 with which the above core shaft 192 is fitted and positioned, the print head 21 covered by a head cover 43, a platen drive shaft 45 (first insertion shaft) which rotationally drives the platen roller 120, and a take-up drive shaft 47 which rotationally drives the take-up core 116 are provided upright. A guide pin 50 (second insertion shaft) is provided upright at a position diagonal to the platen drive shaft 45. Moreover, on the loading base 31, a tape detection section 51 which detects the type (attribute information) of the print tape 102, and a core release section 53 which cancels the rotation stopper of the reel-off core 112 and the take-up core 116 are provided near the take-up drive shaft 47.

Moreover, a pair of small protrusions 55 is provided at diagonal positions on the loading base 31. In addition, a pair of hook pieces 57 which hooks a middle part of the loaded tape cartridge 100 is provided. Meanwhile, in the space on the back of the loading base 31, the above tape feed mechanism section 25, where a motor and a gear train (neither of them being illustrated) or the like for rotating the platen drive shaft 45 and the take-up drive shaft 47 are formed, is arranged inside. The tape feed mechanism section 25 performs power branching via the gear train and thus causes the platen drive shaft 45 and the take-up drive shaft 47 to rotate synchronously.

The print mechanism section 23 has the print head 21 made up of a thermal head, and a head support frame 61 which supports the print head 21 and causes the print head 21 to swivel. Also, the print mechanism section 23 has a head release mechanism (not illustrated) which causes the print head 21 to swivel between a printing position and a retreat position via the head support frame 61, and the head cover 43 covering the print head 21 (and the head support frame 61).

The head release mechanism is actuated, interlocked with the opening/closing of the above open/close cover 7, and causes the print head 21 to move (swivel) to the printing position, interlocked with the closing operation of the open/close cover 7. Also, the head release mechanism causes the print head 21 to move (swivel) to the retreat position, interlocked with the opening operation. The print head 21, having moved to the printing position, abuts against the platen roller 120 of the tape cartridge 100 via the ink ribbon 110 and the print tape 102. The print head 21, having moved to the retreat position, is spaced apart from the platen roller 120. Thus, the print tape 102 and the ink ribbon 110 are prevented from interfering with the print head 21 at the time of loading or unloading the tape cartridge 100.

A plurality of heat generating elements is provided in the print head 21, and the plurality of heat generating elements is arrayed in the same direction as the axial direction of the platen roller 120. Then, printing is carried out by feeding the print tape 102 and the ink ribbon 110 and selectively driving the plurality of heat generating elements. The head cover 43 is formed in a substantially rectangular shape, as viewed in a plan view, and is integrally formed (molded) with the above loading base 31 (cartridge loading section 5). Also, the head cover 43 vertically largely protrudes from the loading base 31, allows the print head 21 to swivel inside the head cover 43, and functions on its outside as a loading guide for the tape cartridge 100.

The tape detection section 51 is made up of a plurality of microswitches 51*a*, is selectively engaged with a section to be detected 180 of the tape cartridge 100, described later, and detects the type including the tape width, tape color, material and the like of the print tape 102. Then, on the basis of the result of the detection, the driving of the print head 21 and the tape feed mechanism section 25 is controlled.

The core release section 53 is made up of two cancellation pins 53*a* for the reel-off core 112 and the take-up core 116. As will be described in detail later, rotation stopper hooks 206 to be hooked on the reel-off core 112 and the take-up core 116, respectively, are provided in the cartridge case 130 (see FIG. 6). As the tape cartridge 100 is loaded, the cancellation pins 53*a* are engaged with these rotation stopper hooks 206, cancelling the rotation stopper of the reel-off core 112 and the take-up core 116.

The platen drive shaft 45 has a platen support shaft 48 (first insertion shaft) extending to be long enough to be inserted in the platen roller 120, and a spline-shaped rotational drive shaft 49 rotatably axially supported at a proximal part of the platen support shaft 48 (see FIG. 3). The rotational power of the tape feed mechanism section 25 is transmitted to this rotational drive shaft 49 and further transmitted from the rotational drive shaft 49 to the platen roller 120 (details will be described later). Also, as will be described in detail later, this platen support shaft 48 and the guide pin 50 have the function of guiding the loading and unloading of the tape cartridge 100.

The take-up drive shaft 47 has a fixed shaft 47*a* and a spline-shaped movable shaft 47*b* rotatably axially supported on the fixed shaft 47*a*. In this case, too, the rotational power of the tape feed mechanism section 25 is transmitted to the movable shaft 47*b* and further transmitted from the movable shaft 47*b* to the take-up core 116.

When the tape cartridge 100 is loaded in the cartridge loading section 5, the core shaft 192 (tape core 104) is engaged with the positioning protrusion 41, and the platen roller 120 is engaged with the platen drive shaft 45. Moreover, the take-up core 116 is engaged with the take-up drive shaft 47. Then, as the open/close cover 7 is closed, the print head 21 swivels and abuts against the platen roller 120 with the print tape 102 and the ink ribbon 110 held in-between. Thus, the tape printing device 1 enters into a print standby state.

Figure 4:
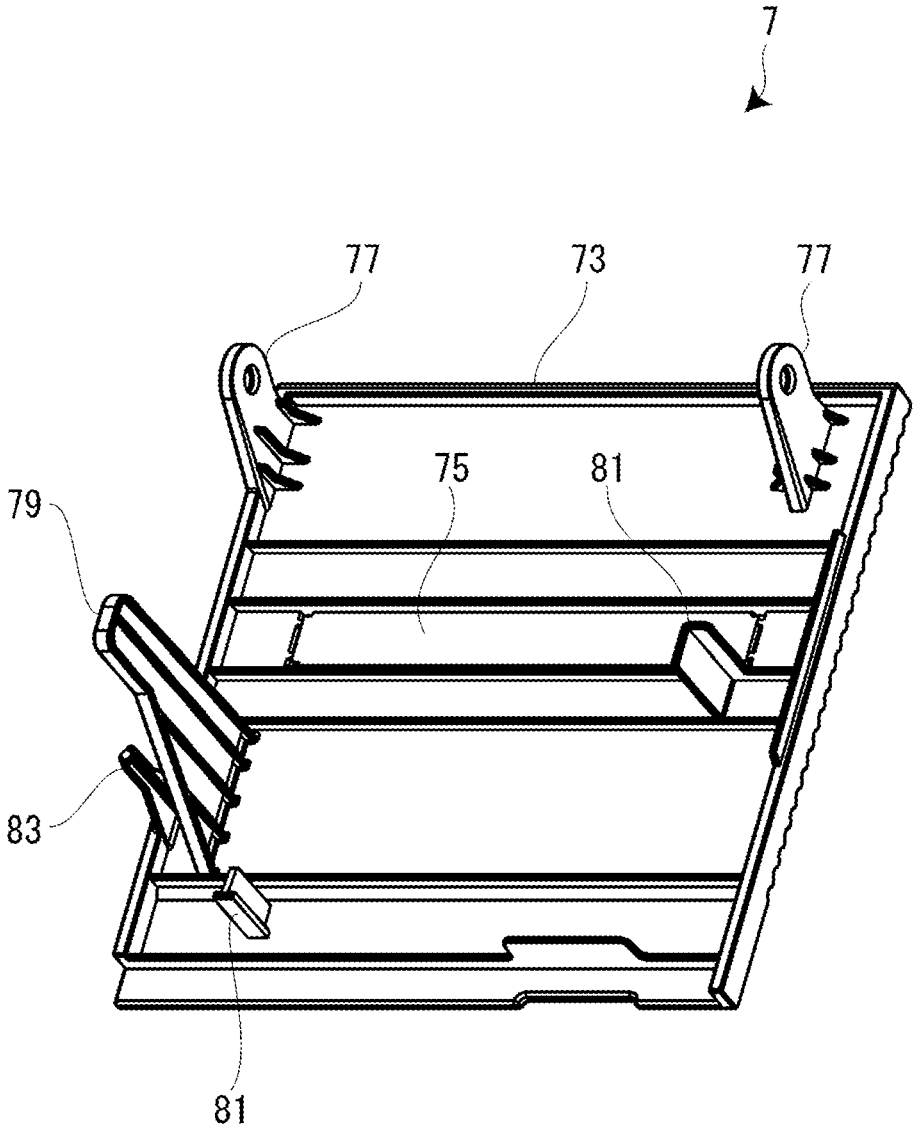
FIG. 4 is a perspective view of an open/close cover, as viewed from the back side.

As shown in FIG. 1 and FIG. 4, the open/close cover 7 is mounted on the device case 3 via a hinge portion 71 provided on the rear side, in such a way as to be able to swivel, that is, to be able to open/close. The open/close cover 7 includes an open/close cover main body 73, and a view window 75 provided at the center of the open/close cover main body 73. Also, the open/close cover 7 includes a pair of shaft support pieces 77 provided in a protruding manner on the back of the open/close cover main body 73 and axially supported on the hinge portion 71 in such away as to be able to swivel, and an actuation lever 79 which is provided in a protruding manner on the back of the open/close cover main body 73 and causes the print head 21 to swivel. Moreover, the open/close cover 7 includes two push-in protrusions 81 which are provided in a protruding manner on the back of the open/close cover main body 73 and push in the tape cartridge 100, and a press protrusion 83 which is provided in a protruding manner on the back of the open/close cover main body 73 and actuates (turns ON) a built-in cover closing detection switch (not illustrated).

The view window 75 is formed to be laterally long and made of a transparent resin (transparent to visible rays) as a separate member from the open/close cover main body 73. Through this view window 75, the tape cartridge 100 loaded in the cartridge loading section 5 can be visually confirmed (the type of the print tape 102 and the amount of tape left). Also, the pair of shaft support pieces 77, the actuation lever 79, the push-in protrusions 81, the press protrusion 83 and a holding portion 85, and the open/close cover main body 73 are integrally formed (molded) of a resin.

The actuation lever 79 protrudes largely from the back of the open/close cover main body 73. With the closing of the open/close cover 7, the actuation lever 79 is inserted in a slit opening 87 provided to the lateral side of the cartridge loading section 5. The actuation lever 79 inserted in the slit opening 87 actuates the above head release mechanism and causes the print head 21. Similarly, with the closing of the open/close cover 7, the press protrusion 83 is inserted in a rectangular opening 91 next to the slit opening 87 and actuates (turns ON) the cover closing detection switch. The push-in protrusions 81 corresponds to positions near the platen roller 120 of the tape cartridge 100. With the closing of the open/close cover 7, the push-in protrusions 81 push in the tape cartridge 100 so that the tape cartridge 100 sits on the loading base 31 of the cartridge loading section 5.

[Details of Tape Cartridge]

Next, the tape cartridge 100 will be described in detail, referring to FIGS. 2A, 2B, 5A, 5B, and 6. In the description of the tape cartridge 100, taking FIGS. 2A and 2B as an example, the forward side in the loading direction, which is the top front side of the tape cartridge 100, is referred to as the "front side", the rear side in the loading direction, which is the opposite side, as the "back side", the lateral side on the left as the "left lateral side", the lateral side on the right as the "right lateral side", the arcuate side on the top as the "distal side", and the side on the bottom as the "proximal side".

The tape cartridge 100 includes the cartridge case 130, and the tape roll 106, the ribbon roll 114, the take-up core 116 and the platen roller 120 accommodated therein, as described above. Also, the tape cartridge 100 has the insertion opening 134 formed in the cartridge case 130, the tape outlet port 138 formed on the left lateral side, near the platen roller 120, and an identification seal 141 (see FIG. 1) bonded over the front side, the left lateral side and the right lateral side of the part where the tape roll 106 is accommodated. The identification seal 141 shows the tape width, tape color, material and the like of the print tape 102 accommodated in the cartridge case 130, at the two parts of the front side and the left lateral side.

The cartridge case 130 forms the outer shell of the tape cartridge 100 (shell structure) and has an "L"-shaped appearance as viewed in a plan view, with the proximal side part on the right lateral side slightly protruding. In the front-back direction, the cartridge case 130 is formed by a lower case 150 which comes to the rear side when the tape cartridge is loaded in the cartridge loading section 5, and an upper case 152 which comes to the forward side. In the cartridge case 130 in this embodiment, the upper case 152 is formed by a molded member of a transparent resin, and the lower case 150 is formed by a molded member of an opaque resin.

The upper case 152 is integrally formed (molded) by a top wall portion 156 forming the front side of the cartridge case 130, and an upper peripheral wall portion 158 suspended on a circumferential edge part of the top wall portion 156. Meanwhile, the lower case 150 is integrally formed (molded) by a bottom wall portion 160 forming the back side of the cartridge case 130, a lower peripheral wall portion 162 provided upright on a circumferential edge part of the bottom wall portion 160, and an opening peripheral wall portion 164 provided upright on the bottom wall portion 160 so as to define the above insertion opening 134.

Figures 5A, 5B:
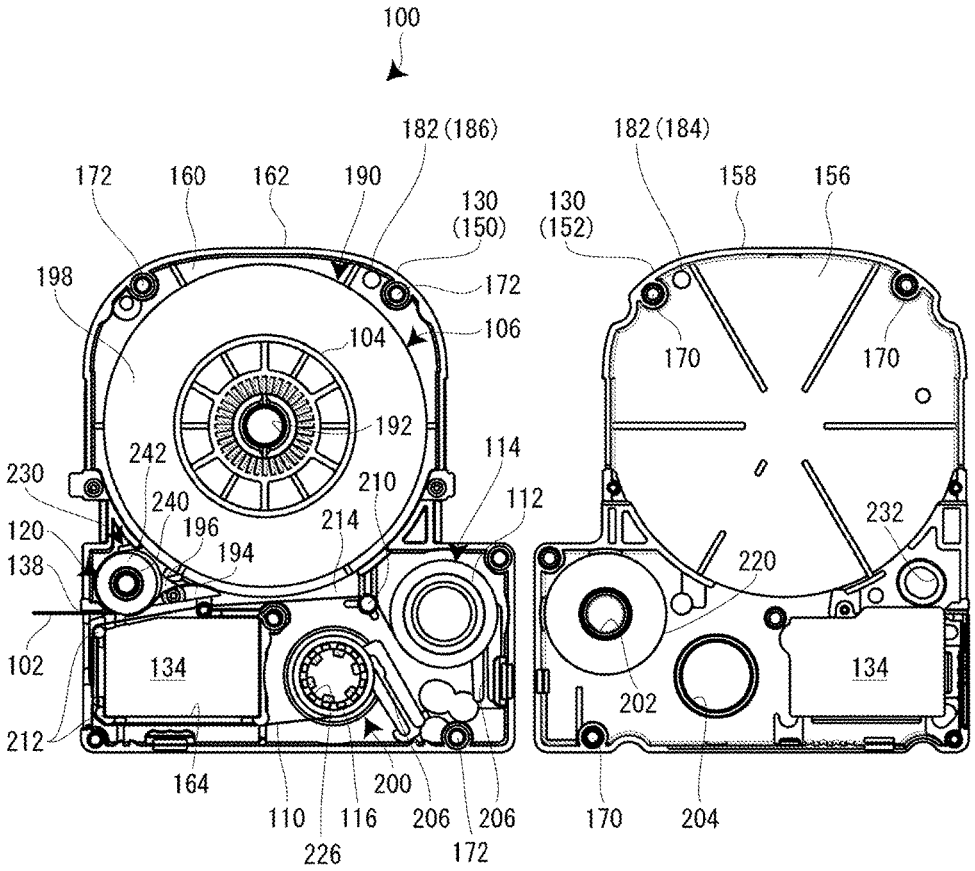
FIG. 5A is a plan view of an upper case and the tape cartridge in the state where the upper case is removed.
FIG. 5B is a back view of the upper case.

A plurality of joint pins 170 is provided at a proper interval on a lower end surface of the upper peripheral wall portion 158 of the upper case 152, whereas a plurality of joint holes 172 corresponding to the plurality of joint pins 170 is provided in the lower peripheral wall portion 162 of the lower case 150 (see FIGS. 5A and 5B). After components such as the tape roll 106 and the ribbon roll 114 are set in the lower case 150, the upper case 152 is joined thereto in such a way that the plurality of joint pins 170 is press-fitted in the plurality of joint holes 172, thus assembling the tape cartridge 100. Each joint hole 172 is a through-hole in consideration of easiness of molding.

Also, a portion to be guided 182 (second receiving portion) through which the guide pin 50 is inserted is provided at a position diagonal to the platen roller 120 (first receiving portion). Specifically, the portion to be guided 182 is formed by a through-hole including a first through-hole 184 which is formed penetrating the top wall portion 156 of the upper case 152 and a second through-hole 186 which is formed penetrating the bottom wall portion 160 of the lower case 150 (details will be described later).

Figure 2A:
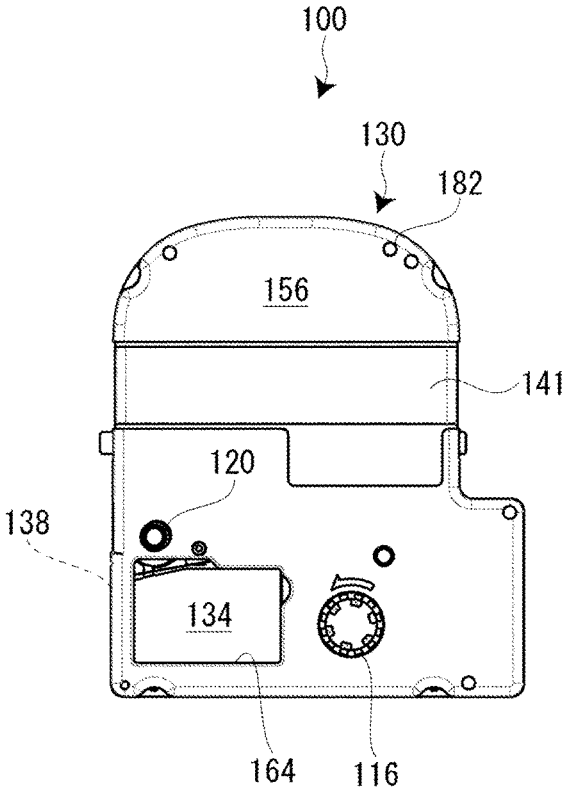
FIG. 2A is a plan view and FIG. 2B is a side view of the tape cartridge according to the embodiment.
Figure 2B:
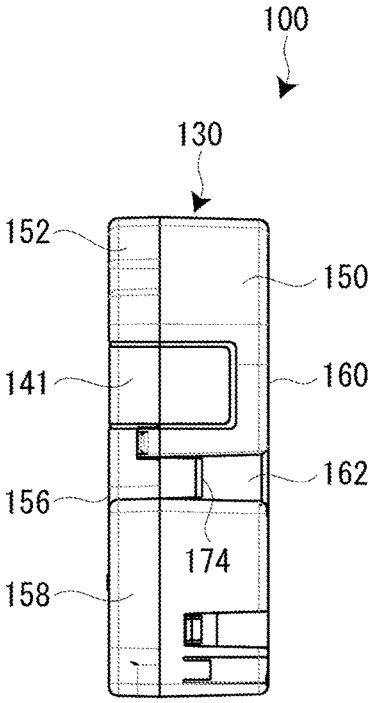
Figure 6:
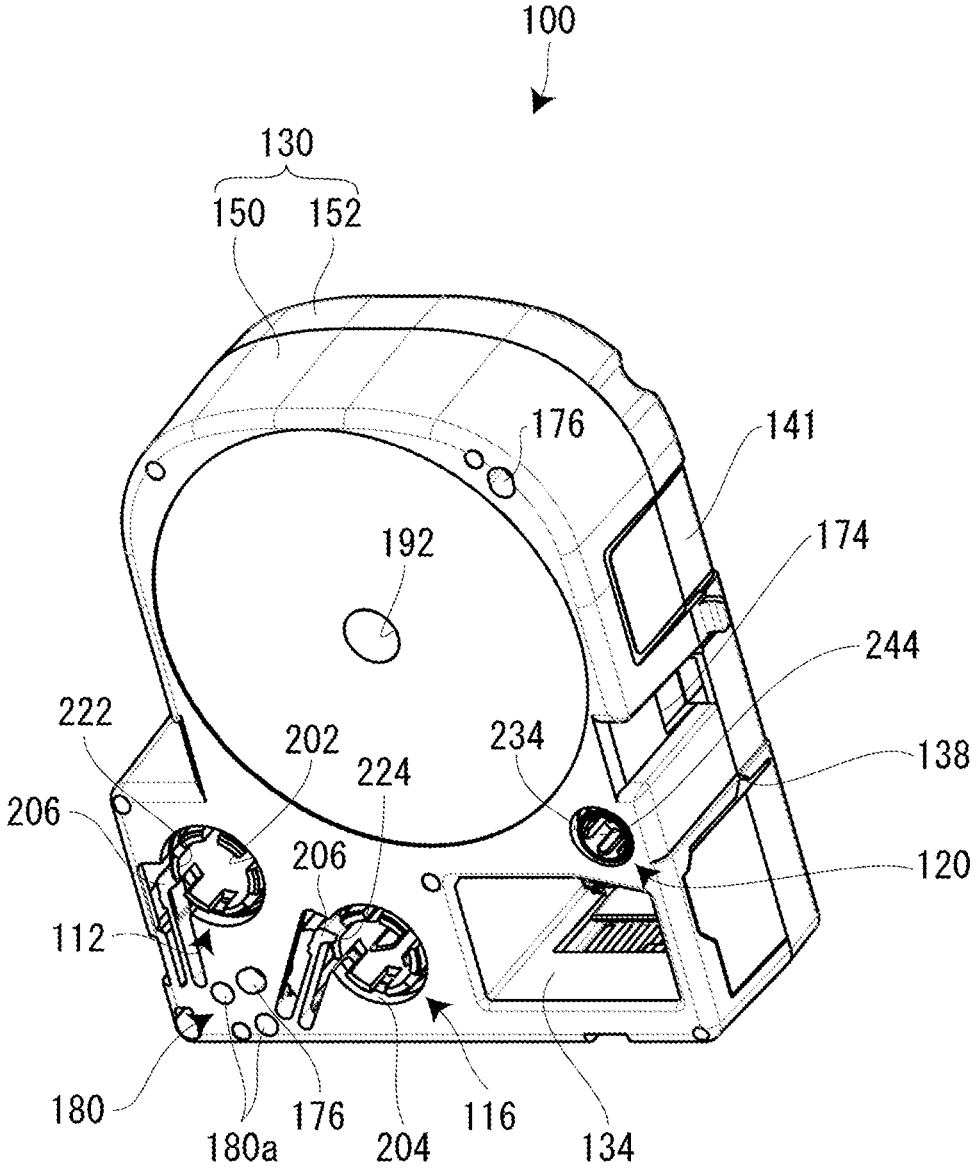
FIG. 6 is a perspective view of the tape cartridge, as viewed from the back side.

Meanwhile, a pair of hook receiving portions 174 to be hooked on the above pair of hook pieces 57 is provided on the left lateral side and the right lateral side of the lower case 150 (see FIGS. 2A and 2B and FIG. 6). As the pair of hook pieces 57 on the side of the cartridge loading section 5 is hooked on the pair of hook receiving portions 174 of the loaded tape cartridge 100, the tape cartridge 100 is prevented from floating up. Also, fitting small holes 176 in which the above pair of small protrusions 55 is fitted with a certain margin are provided on the back side of the lower case 150 (see FIG. 6). As the pair of small protrusions 55 on the side of the cartridge loading section 5 is fitted in the pair of fitting small holes 176 in the loaded tape cartridge 100, the tape cartridge 100 is easily positioned on the loading base 31.

Moreover, on the back side of the lower case 150, the section to be detected 180 corresponding to the above tape detection section 51 is provided at a position in the left corner on the proximal side (right corner as viewed from the front side) (see FIG. 6). The section to be detected 180 is formed in a section corresponding to the plurality of microswitches 51*a* of the detection section 51, and a plurality of bit patterns is acquired according to the presence/absence of receiving holes 180*a* provided in this section. That is, the bit patterns correspond to the type of the above print tape 102 except tape width.

As shown in FIGS. 5A and 5B, a broad tape accommodation area 190 in which the tape roll 106 is accommodated is formed in a space on the upper side (distal end surface side) in the cartridge case 130. At the center of the tape accommodation area 190, the core shaft 192 integrally formed (molded) with the lower case 150 is provided upright. The core shaft 192 is cylindrically formed, and on its outer circumferential surface, the tape roll 106 (tape core 104) is rotatably axially supported. Also, in the tape accommodation area 190, near the platen roller 120, a tape guide 194 which guides the reeled-off print tape 102 to the platen roller 120 is provided upright integrally with the lower case 150.

That is, inside the cartridge case 130, a tape feed path 196 is formed, starting at the tape roll 106 and reaching the tape outlet port 138 via the tape guide 194 and the platen roller 120. The print tape 102 reeled off from the tape roll 106 is guided to the platen roller 120 via the tape guide 194, used for printing there, and further guided from the platen roller 120 to the tape outlet port 138.

The tape roll 106 has the print tape 102 and the tape core 104, and also has two films 198 bonded to both end surfaces of the print tape 102 in a roll shape. The two films 198 prevent the print tape 102 wound on the tape core 104 from unwinding. Also, a reverse rotation stopper mechanism is incorporated in the tape core 104, though not illustrated. When carrying the tape cartridge 100, reverse rotation of the print tape 102 is prevented by this reverse rotation stopper mechanism. Meanwhile, when the tape cartridge 100 is loaded in the cartridge loading section 5 of the tape printing device 1, the reverse rotation stopper by the reverse rotation stopper mechanism is cancelled by the above positioning protrusion 41, thus enabling the print tape 102 to be fed.

On the right side of the proximal part in the cartridge case 130, a ribbon accommodation area 200 is formed next to the insertion opening 134. To the right in the ribbon accommodation area 200, a reel-off side bearing portion 202 which rotatably supports the ribbon roll 114 (reel-off core 112), and to the left, a take-up side bearing portion 204 which rotatably supports the take-up core 116, are formed integrally with the cartridge case 130. That is, the reel-off side bearing portion 202 and the take-up side bearing portion 204 are formed each in the upper case 152 and the lower case 150.

In cut-out parts of the reel-off side bearing portion 202 and the take-up side bearing portion 204 formed in the lower case 150, rotation stopper hooks 206 having their distal parts facing the reel-off side bearing portion 202 and the take-up side bearing portion 204 are integrally formed, respectively. Then, one rotation stopper hook 206 is engaged with the reel-off core 112 and the other rotation stopper hook 206 is engaged with the take-up core 116, each in a rotation stopping state.

In the ribbon accommodation area 200, near the reel-off side bearing portion 202, a first ribbon guide 210 which guides the reeled-off ink ribbon 110 to the platen roller 120 is provided upright integrally with the lower case 150. Also, on the outer circumferential side of the above opening peripheral wall portion 164, a plurality of second ribbon guides 212 which guides the circular movement of the ink ribbon 110 is integrally formed.

That is, inside the cartridge case 130, a ribbon feed path 214 is formed, starting at the ribbon roll 114 and reaching the take-up core 116 via the first ribbon guide 210, the platen roller 120 and the plurality of second ribbon guides 212. The ink ribbon 110 reeled off from the ribbon roll 114 is guided to the platen roller 120 via the first ribbon guide 210, is used for printing there, then further travels around the opening peripheral wall portion 164 (the plurality of second ribbon guides 212) from the platen roller 120, and is taken up on the take-up core 116.

The ribbon roll 114 has the ink ribbon 110 and the reel-off core 112, and also has a ring-shaped leaf spring 220 which applies a braking load to the reel-off core 112 (see FIG. 5B). The leaf spring 220 is formed in a wave shape in the circumferential direction and is provided between the top wall portion 156 of the upper case 152 and the reel-off core 112 in the axial direction. That is, a rotation braking load is applied to the reel-off core 112 by the spring force of this leaf spring 220. Thus, a back tension is applied to the ink ribbon 110 being reeled off by the take-up core 116, thus preventing the ink ribbon 110 from loosening.

The reel-off core 112 is cylindrically formed, and at its end on the side of the lower case 150, a plurality of cut-outs 222 is formed in the circumferential direction (see FIG. 6). Then, the above rotation stopper hooks 206 are to be engaged with and disengaged from the plurality of cut-outs 222. While the reel-off side bearing portion 202 on the side of the lower case 150 supporting the reel-off core 112 is formed as a circular opening, the reel-off side bearing portion 202 on the side of the upper case 152 is formed as a cylindrical protruding part. Then, the above leaf spring 220 is mounted on this protruding part (see FIG. 5B for each of these parts).

Similarly, the take-up core 116 is cylindrically formed, and at its end on the side of the lower case 150, a plurality of cut-outs 224 is formed in the circumferential direction. Then, the above rotation stopper hooks 206 are engaged with and disengaged with the plurality of cut-outs 224. Also, a spline groove 226 is formed on the inner circumferential surface of the take-up core 116 and spline-engaged with the above take-up drive shaft 47. Thus, the rotational force of the take-up drive shaft 47 is transmitted to the take-up core 116, and the ink ribbon 110 is taken up.

On the left side of the proximal part in the cartridge case 130, a platen accommodation area 230 is formed next to the insertion opening 134. In the center of the platen accommodation area 230, a lower bearing portion 234 (see FIG. 6) in the form of an elliptic (oval) opening formed in the lower case 150, and an upper bearing portion 232 (see FIG. 5B) in the form of an elliptic opening formed in the upper case 152 are provided. Then, on the upper bearing portion 232 and the lower bearing portion 234, the platen roller 120 is supported in a rotatable and slightly laterally movable manner. That is, the platen roller 120 supported on the upper bearing portion 232 and the lower bearing portion 234, which are elliptical, is configured to be laterally movable (slightly movable) between a home position where the platen roller 120 is engaged with the platen drive shaft 45 and a nipping position where the platen roller 120 abuts against the tape guide 194 with the print tape 102 nipped between them.

Incidentally, this tape cartridge 100 is carried in the state where the reel-off end of the print tape 102 is slightly protruding outward from the tape outlet port 138 (see FIG. 1). In this case, if a push-in force or pull-in force acts on the reel-off end of the print tape 102 by mistake, the platen roller 120, which is drawn by this, moves to the above nipping position. Thus, the reel-off end of the print tape 102 is prevented from being pulled into the cartridge case 130 from the tape outlet port 138.

The platen roller 120 has a cylindrical roller base 240 and a rubber roller 242 mounted on the outer circumferential surface of the roller base 240. The rubber roller 242 has a length corresponding to the print head 21 in the axial direction. The print head 21, having moved to the printing position, abuts against this rubber roller 242 with the print tape 102 and the ink ribbon 110 held between them. Also, a spline groove 244 is formed on the inner circumferential surface of the roller base 240 and spline-engaged with the rotational drive shaft 49 of the above platen drive shaft 45. Thus, the rotational force of the platen drive shaft 45 is transmitted to the platen roller 120, and the print tape 102 (and the ink ribbon 110) is fed for printing.

Structures Around Platen Drive Shaft and Guide Pin (First Embodiment)

Next, referring to FIG. 7 and FIGS. 9A and 9B, the structures around the platen drive shaft 45 and the guide pin 50 according to a first embodiment will be described in detail along with the structures of the portion to be guided 182 and the platen roller 120 of the tape cartridge 100. As described above, in the cartridge loading section 5, the platen drive shaft 45 and the guide pin 50 (second insertion shaft) are provided, spaced apart from each other. Corresponding to these, the platen roller 120 and the portion to be guided 182 (second receiving portion) are provided in the tape cartridge 100.

Figure 7:
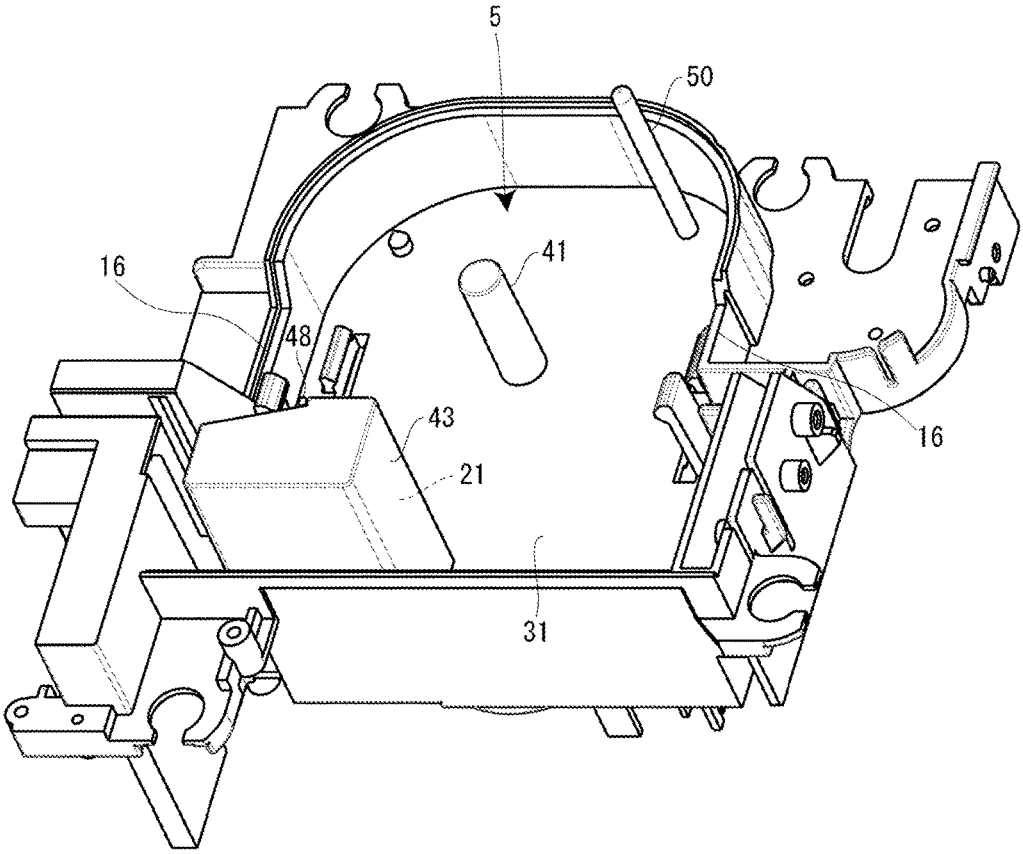
FIG. 7 is an enlarged perspective view of the cartridge loading section.
Figure 9A:
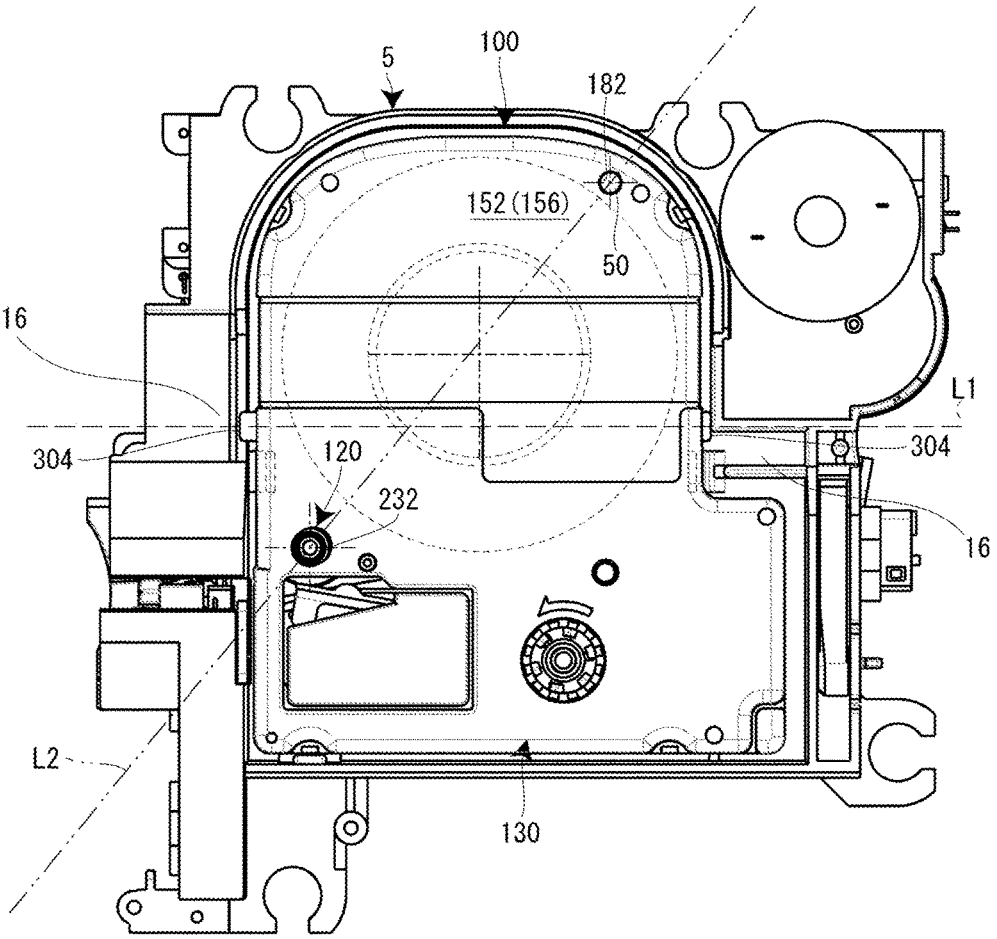
FIG. 9A is a plan view and FIG. 9B is a cross-sectional view of the state where the tape cartridge according to the first embodiment is loaded in the cartridge loading section.
Figure 9B:
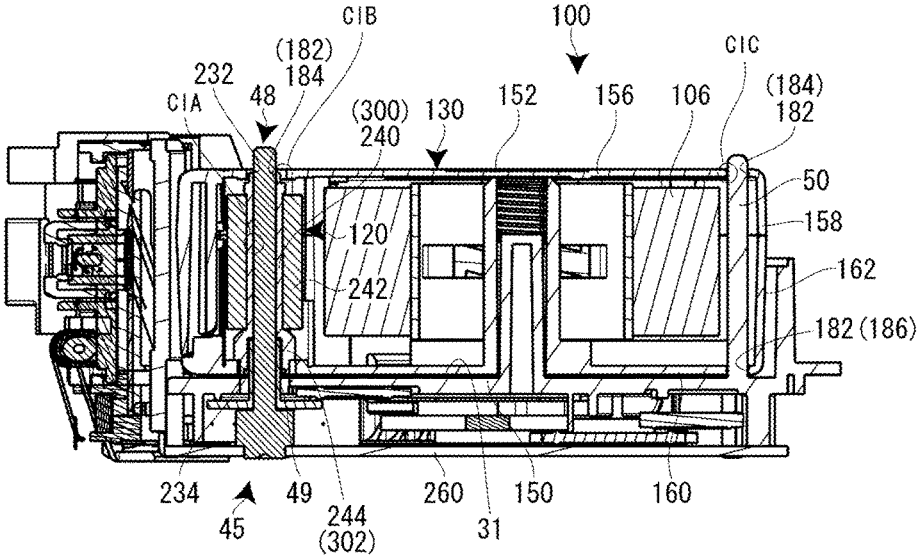

As shown in FIG. 7 and FIGS. 9A and 9B, the platen drive shaft 45 has the platen support shaft 48 (first insertion shaft) provided upright on a device frame 260 situated below the loading base 31, and the rotational drive shaft 49 rotatably supported on a lower part of the platen support shaft 48. The platen support shaft 48 is fixed in a cantilevered state on the device frame 260 and extends in the loading/unloading direction of the tape cartridge 100, penetrating the loading base 31. Also, the platen support shaft 48 extends to substantially the same height as the head cover 43.

When the tape cartridge 100 is loaded in the cartridge loading section 5, the platen support shaft 48 is inserted through the roller base 240 of the platen roller 120. Therefore, the platen support shaft 48 (platen drive shaft 45) rotatably supports the platen roller 120 and also functions as a loading/unloading guide for the tape cartridge 100 via the platen roller 120.

The guide pin 50 is provided upright on the loading base 31 of the cartridge loading section 5 and extends in the loading/unloading direction of the tape cartridge 100, similarly to the platen support shaft 48. That is, the guide pin 50 is formed (molded) integrally with the loading base 31 and extends to substantially the same height as the platen support shaft 48. In this case, the guide pin 50 and the platen support shaft 48 have a length corresponding to the thickest tape cartridge 100. That is, the guide pin 50 and the platen support shaft 48 have a length to penetrate the loaded tape cartridge 100 in the loading direction. Also, a distal end part of the guide pin 50 is hemispherically chamfered in order to improve the loadability of the tape cartridge 100.

When the tape cartridge 100 is loaded in the cartridge loading section 5, the guide pin 50 is inserted through the portion to be guided 182 of the cartridge case 130. Thus, the guide pin 50 functions as a loading/unloading guide for the tape cartridge 100 via the portion to be guided 182.

Figure 10A:
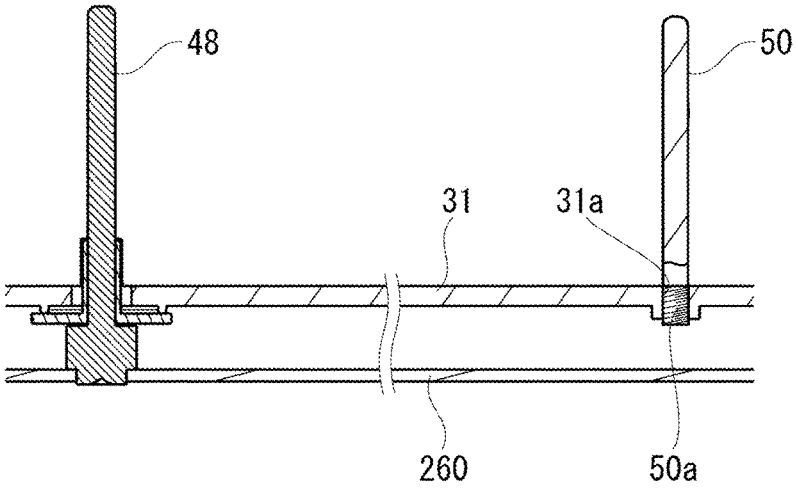
FIGS. 10A and 10B are structural views of the peripheries of a guide pin according to modifications of the first embodiment.
Figure 10B:
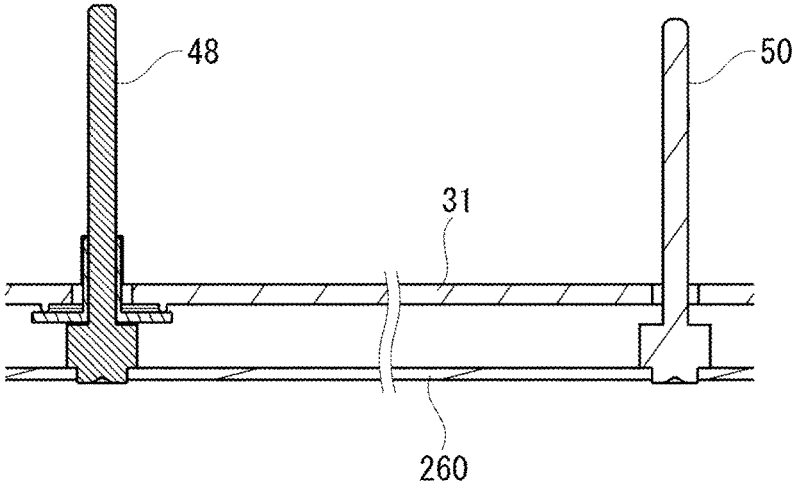

FIGS. 10A and 10B show modifications of the peripheries of the guide pin 50.

In a first modification in FIG. 10A, the guide pin 50 is screwed at its proximal end part with the loading base 31. That is, a male screw 50*a* is formed at the proximal end part of the guide pin 50, and a female screw 31*a* corresponding to the male screw 50*a* is formed on the loading base 31. As the guide pin 50 is screwed with the female screw 31*a* of the loading base 31, the guide pin 50 comes into the state of being provided upright on the loading base 31. It is preferable that the male screw 50*a* and the female screw 31*a* are fixed with an adhesive or the like. In this first modification, the guide pin 50 can be accurately formed and can be easily mounted on the loading base 31.

In a second modification in FIG. 10B, the guide pin 50 is fixed at its proximal end part to the device frame 260. As described above, the platen support shaft 48 is fixed to the device frame 260 by press-fitting or the like, and the guide pin 50 is similarly fixed to the device frame 260 by press-fitting or the like. That is, the platen support shaft 48 and the guide pin 50 are provided upright on the device frame 260 and extend, penetrating the loading base 31. In this second modification, the guide pin 50 and the platen support shaft 48 can be provided with high positioning accuracy with respect to each other.

Figure 8:
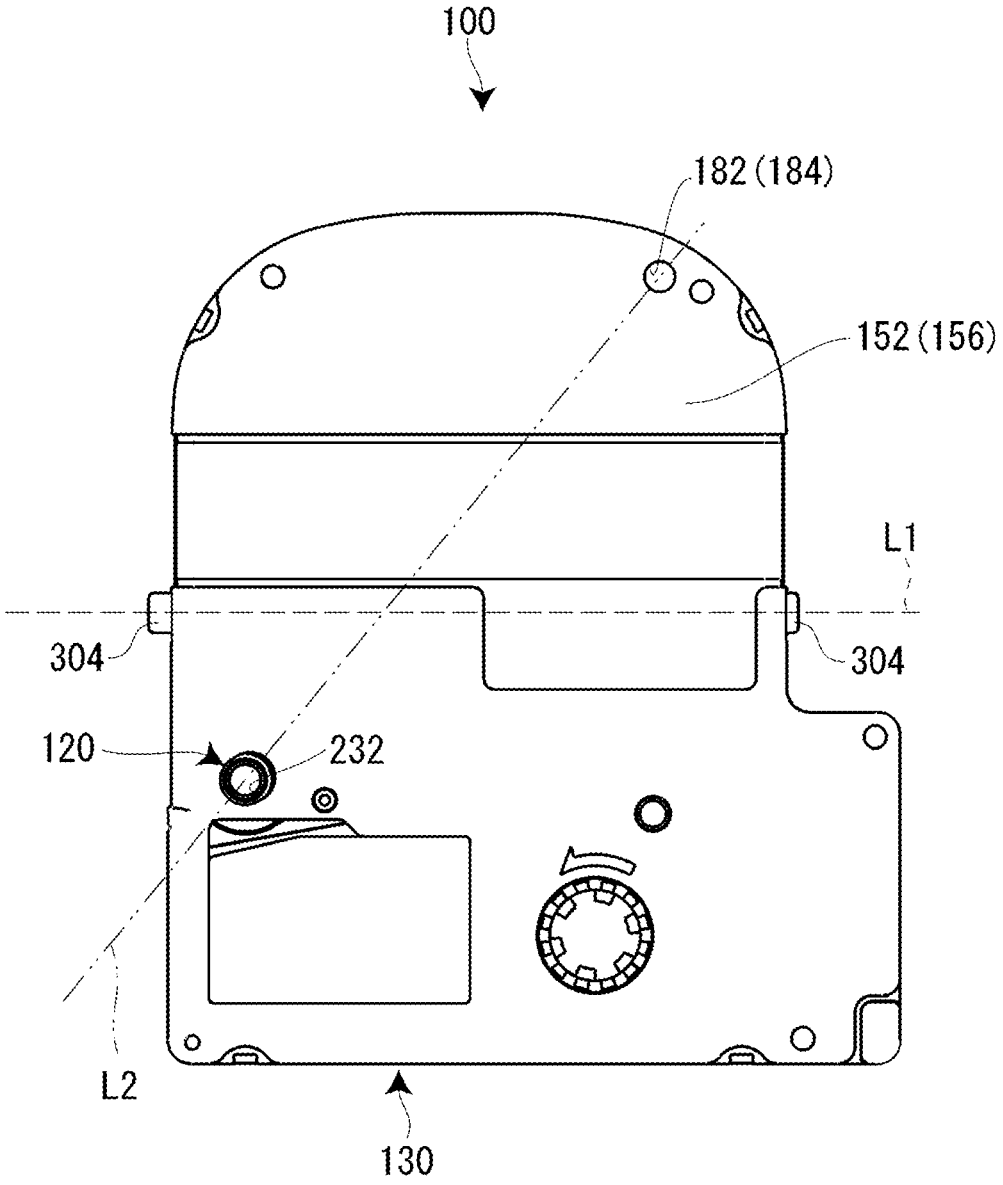
FIG. 8 is a plan view of a tape cartridge according to a first embodiment.

Meanwhile, as shown in FIG. 8 and FIGS. 9A and 9B, in the tape cartridge 100, the platen roller 120 is provided in such a way as to be supported by the upper bearing portion 232 of the upper case 152 and the lower bearing portion 234 of the lower case 150. Also, in the tape cartridge 100, the portion to be guided 182, having the first through-hole 184 which is formed penetrating the upper case 152 and the second through-hole 186 which is formed penetrating the lower case 150, is provided.

As described above, the platen roller 120 has the roller base 240 and the rubber roller 242. The roller base 240 is integrally formed by a cylindrical roller holding portion 300 which holds the rubber roller 242, and an annular engagement portion 302 continuing from the roller holding portion 300 and having the spline groove 244 formed therein. Also, the roller base 240 is supports with a slight margin by the upper bearing portion 232 and the lower bearing portion 234 of the cartridge case 130, and is positioned by the platen support shaft 48 inserted through the shaft hole (first receiving portion) of the roller holding portion 300.

The first through-hole 184 of the portion to be guided 182 is formed in the top wall portion 156, near the upper peripheral wall portion 158 of the upper case 152. Similarly, the second through-hole 186 is formed in the bottom wall portion 160, near the lower peripheral wall portion 162 of the lower case 150. That is, the portion to be guided 182 is formed in such a way that the guide pin 50 inserted through this is situated in the gap between the tape roll 106, and the upper peripheral wall portion 158 and the lower peripheral wall portion 162, and follows the upper peripheral wall portion 158 and the lower peripheral wall portion 162. If the upper peripheral wall portion 158 and the lower peripheral wall portion 162 are thickly formed, the portion to be guided 182 may be formed penetrating the upper peripheral wall portion 158 and the lower peripheral wall portion 162.

Incidentally, in the case of extracting the tape cartridge 100, the pair of hook receiving portions 174 is released from the above pair of hook pieces 57 in the initial stage of the extraction. However, due to their structures, the pair of hook receiving portions 174 is rarely released simultaneously from the pair of hook pieces 57. Therefore, the tape cartridge 100 can easily tilt in the initial stage of the extraction. Meanwhile, in the relation between the platen drive shaft 45 and the platen roller 120, the platen support shaft 48 (first insertion shaft) is inserted in the shaft hole (first receiving portion) of the roller holding portion 300. The clearance CIA between the two is set to be very small because it affects the print quality.

However, the platen roller 120 is supported in the cartridge case 130, with a margin to enable the platen roller 120 to laterally move (slightly move) with respect to the cartridge case 130, as described above. That is, the clearance C1B between the upper bearing portion 232 (roller receiving portion) and the lower bearing portion 234 (roller receiving portion) of the cartridge case 130, and the roller holding portion 300 of the platen roller 120, is set to be large in order to enable the slight movement.

Therefore, in the initial stage of the extraction, even if the tape cartridge 100 tilts, if the tilt is within the clearance C1B, the roller holding portion 300 and the platen support shaft 48 maintain their linearity and do not greatly resist the extraction. In contrast, if the tilt of the tape cartridge 100 exceeds the clearance C1B, the cartridge case 130 regulates the movement of the roller holding portion 300, and the roller holding portion 300 and the platen support shaft 48 tilt, greatly resisting the extraction.

Therefore, the guide pin 50, which guides the extraction, functions to restrain the tilt of the cartridge case 130 so that the tilt of the tape cartridge 100 will not exceed the clearance C1B. Specifically, the clearance C1C between the first through-hole 182 (second receiving portion) and the second through-hole 186 (second receiving portion) of the cartridge case 130, and the guide pin 50 (second insertion shaft), is made smaller than the clearance C1B. That is, the clearance C1A<the clearance C1B holds, and the clearance C1C<the clearance C1B holds. Thus, it is possible to realize particularly smooth extraction of the tape cartridge 100 without affecting the print quality.

When combined with the upper bearing portion 232 and the lower bearing portion 234 (annular engagement portion 302 with the spline groove 244 formed therein) of the platen roller 120, the above first through-hole 184 and second through-hole 186 exist in easily recognizable places spaced apart from each other, whether as viewed from the side of the upper case 152 or as viewed from the side of the lower case 150. Therefore, when the user puts the tape printing device 1 in front of him/herself and holds the tape cartridge 100 in the hand, looking at the cartridge loading section 5, these through-holes function as landmarks that enable easy recognition of the front and back of the tape cartridge 100 (the spline groove 244 is different in appearance from a simple hole and therefore can be easily identified) and its forward-rear and left-right directions. Thus, the tape cartridge 100 can be directed in the correct direction and thus loaded in the cartridge loading section 5.

Also, the tape cartridge 100 has a pair of finger hook protrusions 304 (parts to be gripped) on both left and right lateral surfaces (surface opposite to each other that can be gripped) of the cartridge case 130, thus making it less slippery for fingers at the time of gripping operation, and enabling secure gripping. The pair of finger hook protrusions 304 is formed integrally with the left and right outer surfaces of the lower peripheral wall portion 162 of the lower case 150.

However, the finger hook protrusions 304 are not necessarily required. Parts of the upper peripheral wall portion 158 of the tape cartridge 100 that are opposite the above recess portions 16 continuing from both left and right sides of the cartridge loading section 5 of the tape printing device 1 can be directly utilized as the parts to be gripped. In that case, the design is simplified, though the gripping power at the time of gripping is slightly lower.

As described above, the front and back, and the forward-rear and left-right directions of the tape cartridge 100 can be recognized, using the first through-hole 184 and the second through-hole 186, and the upper bearing portion 232 and the lower bearing portion 234 (annular engagement portion 302 with the spline groove 244 formed therein) of the platen roller 120, as landmarks. Therefore, when loading the tape cartridge 100 in the cartridge loading section 5 of the tape printing device 1, the positions on the upper peripheral wall portion 158 of the tape cartridge 100 corresponding to the above left and right recess portions 16 are necessarily used as gripping portions, irrespective of the presence/absence of the finger hood protrusions 304.

In the tape cartridge 100 configured as above, the portion to be guided 182 is arranged at a distal site of the cartridge case 130 that is the farthest from the platen roller 120 across an imaginary line L1 connecting the pair of finger hook protrusions 304, as viewed in a plan view (as viewed from the loading/unloading direction), as shown in FIG. 8 and FIGS. 9A and 9B. Then, the distance between the portion to be guided 182 and the finger hook protrusion 304 corresponding to the gripping portion on the right side in FIG. 8 and FIGS. 9A and 9B (the gripping portion that is more distance from the platen roller 120) is shorter than the distance between the portion to be guided 182 and the finger hook protrusion 304 corresponding to the gripping portion on the left side in FIG. 8 and FIGS. 9A and 9B (the gripping portion that is closer to the platen roller 120).

Meanwhile, since the pair of finger hook protrusions 304 and the two recess portions 16 correspond to each other, the above positional relation, when viewed from the side of the tape printing device 1 (the side of the cartridge loading section 5), is described as follows. That is, the guide pin 50 is arranged at a position corresponding to a distal site of the cartridge case 130 that is the farthest from the platen support shaft 48 across the imaginary line L1 connecting the two recess portions 16, as viewed in a plan view (as viewed from the loading/unloading direction). Then, the distance between the guide pin 50 and the recess portion 16 corresponding to the gripping portion on the right side in FIG. 8 and FIGS. 9A and 9B (the recess portion 165 that is farther from the platen roller 120) is shorter than the distance between the guide pin 50 and the recess portion 16 corresponding to the gripping portion on the left side in FIG. 8 and FIGS. 9A and 9B (the recess portion 16 that is closer to the platen roller 120).

With such positional relations, a tilt in the posture of the tape cartridge 100 or imbalance in the forces applied is less likely to occur when loading or unloading the tape cartridge 100 in and from the cartridge loading section 5 of the tape printing device 1 while two finger hook protrusions 304 (parts to be gripped) are held by fingers. Also, smooth loading and unloading without any pull is made possible. At the same time, since the platen roller 120 and the portion to be guided 182 exist visibly at positions spaced apart from each other, there is no concern about mistaking the direction of loading the tape cartridge 100.

Also, the platen support shaft 48 (platen drive shaft 45) and the guide pin 50 of the cartridge loading section 5 are arranged, corresponding to the arrangement positions of the platen roller 120 and the portion to be guided 182, respectively. Then, positional errors between the platen roller 120 and the portion to be guided 182, and the platen support shaft 48 and the guide pin 50, in the manufacturing, are absorbed by the axial supporting of the platen roller 120 with a margin in the cartridge case 130.

Structures Around Platen Drive Shaft and Guide Pin (Second Embodiment)

Next, referring to FIG. 11, the structures around the platen drive shaft 45 and the guide pin 50 according to a second embodiment will be described in detail along with the structures of the portion to be guided 182 and the platen roller 120 of the tape cartridge 100. Also, in the second embodiment, different parts from the first embodiment will be mainly described.

Figure 11:
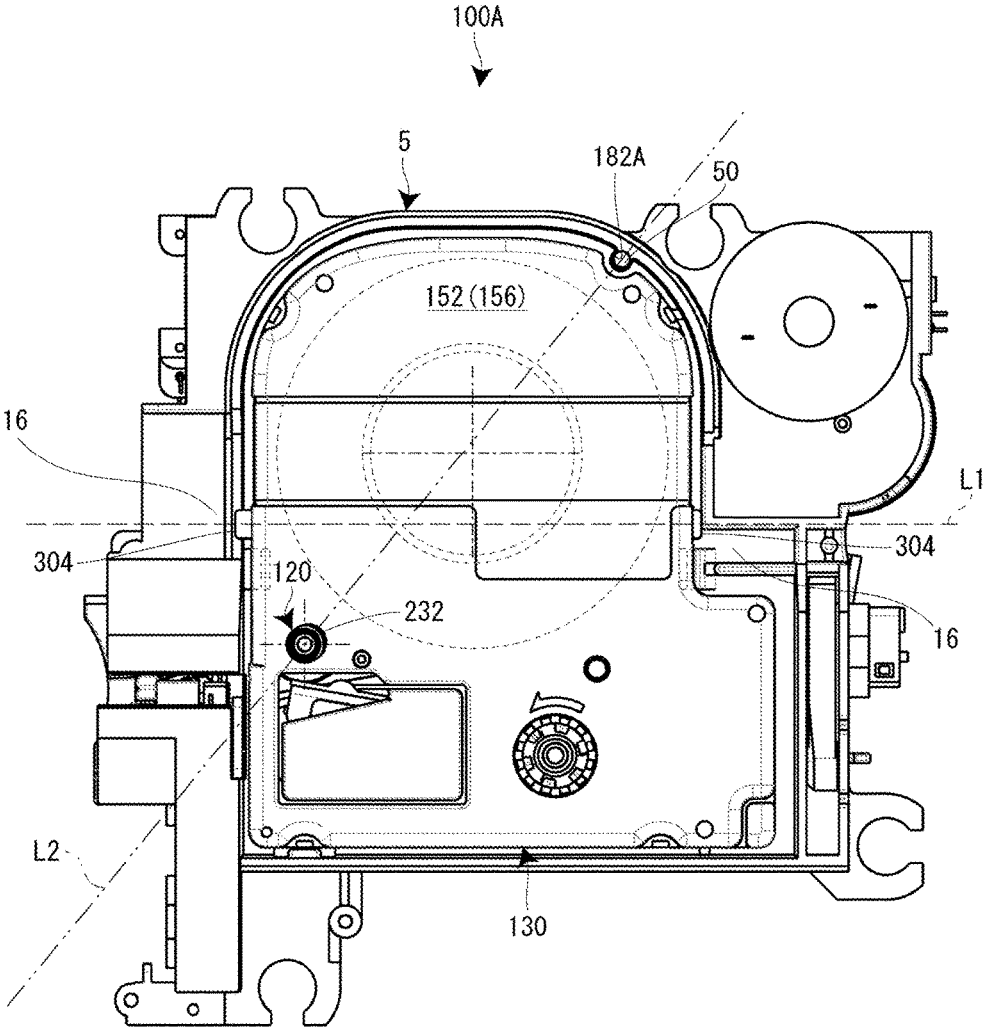
FIG. 11 is a plan view of the state where a tape cartridge according to a second embodiment is loaded in the cartridge loading section.

As shown in FIG. 11, the portion to be guided 182 of the tape cartridge 100 in the second embodiment is provided in a recessed manner as a groove on the outer circumferential surface of the cartridge case 130. Specifically, the portion to be guided 182 is formed by making the upper peripheral wall portion 158 of the lower case 150 and the lower peripheral wall portion 162 of the lower case 150 concavely in a substantially hemispherical shape toward the platen roller 120. In terms of an imaginary line L2 connecting the platen roller 120 and this portion to be guided 182, this portion to be guided 182 as a groove provided in a recessed manner in a direction such that there is a wall at a position intersecting the imaginary line L2. Therefore, this wall effectively provides guidance at the time of loading and unloading.

Also in this case, the portion to be guided 182 is arranged at a distal site of the cartridge case 130 that is the farthest from the platen roller 120 across the imaginary line L1 connecting the pair of finger hook protrusions 304. Also, the platen support shaft 48 (platen drive shaft 45) and guide pin of the cartridge loading section 5 are arranged, corresponding to the arrangement positions of the platen roller 120 and the portion to be guided 182.

As described above, since the portion to be guided 182 is arranged at the distal site of the cartridge case 130 that is the farthest from the platen roller 120 across the imaginary line L1 connecting the pair of finger hook protrusions 304, the tape cartridge 100 can be gripped at the two finger hook protrusions 304 in the correct direction, using the platen roller 120 and the portion to be guided 182 as landmarks.

Also, when loading and unloading the tape cartridge 100 in and from the cartridge loading section 5 of the tape printing device 1, the forces applied to the tape cartridge 100 via the pair of finger hook protrusions 304 act relatively evenly on the portion to be guided 182 and the platen roller 120. Therefore, a tilt in the posture of the tape cartridge 100 or imbalance in the forces applied is less likely to occur, thus enabling smooth loading and unloading without any pull. That is, in loading and unloading with the direction of the tape cartridge corrected, the loading/unloading forces can be made to act evenly on the portion to be guided 182 and the platen roller 120 with large frictional resistance. Therefore, the tape cartridge 100 does not tilt and the tape cartridge 100 can be smoothly loaded in and unloaded from the cartridge loading section 5.

Also, since the portion to be guided 182 is arranged, sufficiently spaced apart from the platen roller 120, the loading force and pull-out force are less likely to be lopsided, and the tape cartridge 100 can be smoothly loaded in and unloaded from the cartridge loading section 5 in this respect as well. While the guide pin 50 and the portion to be guided 182 in the embodiment have a circular cross section, these components may have a semicircular cross section, polygonal cross section and the like. Also, if a feed roller is provided separately from the platen roller 120 (platen) or instead of the platen roller 120, the support shaft of the feed roller may be made to function as a loading/unloading guide, instead of the platen support shaft 48.

The invention claimed is:

1. A tape printing device comprising:

a cartridge loading section in which a tape cartridge is detachably loaded, the tape cartridge having a first receiving portion and a second receiving portion extending in a loading/unloading direction and arranged spaced apart from each other;

two recess portions which continue from the cartridge loading section and in which fingers for gripping the loaded tape cartridge are inserted;

a first insertion shaft provided in the cartridge loading section and inserted in the first receiving portion of the loaded tape cartridge, the first insertion shaft rotatably supporting a platen roller provided in the tape cartridge and using the first receiving portion as a shaft hole, in the state in which the tape cartridge is loaded; and a second insertion shaft provided in the cartridge loading section and inserted in the second receiving portion of the loaded tape cartridge;

wherein, as viewed from a loading direction of the tape cartridge, the second insertion shaft is situated on a side opposite to the first insertion shaft across an imaginary line connecting the two recess portions and is arranged at a site where a distance from the second insertion shaft to the recess portion at a position farther from the first insertion shaft, of the two recess portions, is shorter than a distance from the second insertion shaft to the recess portion at a position closer to the first insertion shaft, and wherein a clearance between the second insertion shaft and the second receiving portion is smaller than a clearance between the platen roller and a roller receiving portion of a cartridge case which rotatably supports the platen roller.

2. The tape printing device according to claim 1, wherein the first insertion shaft and the second insertion shaft penetrate the tape cartridge in the state where the tape cartridge is loaded.

3. A tape printing system comprising:

the tape printing device according to claim 2; and the tape cartridge detachably loaded in the cartridge loading section.

4. The tape printing device according to claim 1, wherein the second insertion shaft is formed integrally with a loading base portion of the cartridge loading section where the tape cartridge sits.

5. A tape printing system comprising:

the tape printing device according to claim 4; and the tape cartridge detachably loaded in the cartridge loading section.

6. The tape printing device according to claim 1, wherein the second insertion shaft is screwed, at a proximal end part, together with a loading base portion of the cartridge loading section where the tape cartridge sits.

7. A tape printing system comprising:

the tape printing device according to claim 6; and the tape cartridge detachably loaded in the cartridge loading section.

8. The tape printing device according to claim 1, wherein the first insertion shaft and the second insertion shaft are fixed to a device frame at a proximal end part and extend, penetrating a loading base portion of the cartridge loading section where the tape cartridge sits.

9. A tape printing system comprising:

the tape printing device according to claim 8; and the tape cartridge detachably loaded in the cartridge loading section.

10. The tape printing device according to claim 1, wherein a distal end part of the second insertion shaft is hemispherically formed.

11. A tape printing system comprising:

the tape printing device according to claim 10; and the tape cartridge detachably loaded in the cartridge loading section.

12. A tape printing system comprising:

the tape printing device according to claim 1; and the tape cartridge detachably loaded in the cartridge loading section.

13. The tape printing device according to claim 1, further comprising:

a loading base portion of the cartridge loading section where the tape cartridge sits; and a positioning protrusion with which a core shaft of the tape cartridge is fitted and positioned, and provided on the loading base portion, wherein the first insertion shaft and the second insertion shaft are provided upright from opposite sides of the positioning protrusion.

* * * * *